US007004182B2

(12) United States Patent
Duval et al.

(10) Patent No.: US 7,004,182 B2
(45) **Date of Patent: *Feb. 28, 2006**

(54) ENHANCED ULTRASONIC CLEANING DEVICES

(75) Inventors: Dean Larry Duval, Lebanon, OH (US); Tim Van Hauwermeiren, Pescara (IT); Sonia Gaaloul, Strombeek-Bever (BE); Lieven Richard Deketele, Zulte (BE); Michael Ray McDonald, Middletown, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 6 days.

This patent is subject to a terminal disclaimer.

(21) Appl. No.: 10/272,883

(22) Filed: Oct. 17, 2002

(65) Prior Publication Data

US 2003/0084535 A1 May 8, 2003

Related U.S. Application Data

(60) Provisional application No. 60/330,379, filed on Oct. 18, 2001.

(51) Int. Cl.
*B08B 3/12* (2006.01)

(52) U.S. Cl. ..... 134/184; 134/113; 134/172; 15/363; 15/97.1

(58) Field of Classification Search ..... 134/172, 134/184, 113; 68/3 SS, 5 B; 15/22.1, 24, 15/29, 97.1, 363
See application file for complete search history.

(56) References Cited

U.S. PATENT DOCUMENTS 2,814,575 A * 11/1957 Lange, Jr. ..... 134/1
3,342,076 A 9/1967 Bodine
3,357,033 A 12/1967 Sawyer
3,829,328 A * 8/1974 Blustain ..... 134/1
3,849,195 A 11/1974 Powell, Jr. et al.
3,946,599 A 3/1976 Patt
4,032,803 A 6/1977 Durr et al.
4,069,541 A 1/1978 Williams et al.
4,103,519 A 8/1978 Davidson
4,111,546 A * 9/1978 Maret ..... 399/349
4,168,560 A 9/1979 Doyel
4,183,011 A 1/1980 Massa
4,225,803 A 9/1980 Goof
4,225,814 A * 9/1980 Gantz et al. ..... 320/115
4,250,586 A 2/1981 Timian
4,307,484 A 12/1981 Williams
4,308,229 A 12/1981 Voit
4,448,750 A 5/1984 Fuesting
4,591,777 A * 5/1986 McCarty et al. ..... 320/110
4,830,784 A 5/1989 Meffert et al.
5,202,523 A 4/1993 Grossman et al.
5,218,980 A 6/1993 Evans (Continued)

FOREIGN PATENT DOCUMENTS

DE 35 34 898 A1 4/1987

(Continued)

*Primary Examiner*—Alexander Markoff
(74) *Attorney, Agent, or Firm*—Julia A. Glazer; Brant C. Cook; Kim William Zerby

(57) ABSTRACT

Ultrasonic cleaning devices comprise a sonotrode and a power supply adapted to supply current to the sonotrode, and further include one or more features which facilitate use of the ultrasonic cleaning devices by consumers, improve the safety of the ultrasonic cleaning devices when used by consumers, and/or improve the cleaning efficiency of the ultrasonic cleaning devices when used by consumers.

5 Claims, 7 Drawing Sheets

U.S. PATENT DOCUMENTS

| | | | | |
|---|---|---|---|---|
| 5,247,716 | A | 9/1993 | Bock | |
| 5,297,512 | A | 3/1994 | Sharp | |
| 5,309,590 | A | 5/1994 | Giuliani et al. | |
| 5,311,632 | A | 5/1994 | Center | |
| 5,350,457 | A | 9/1994 | Kitazawa et al. | |
| 5,369,831 | A | 12/1994 | Bock | |
| 5,372,741 | A | 12/1994 | Tomaszewski | |
| 5,377,709 | A | 1/1995 | Shibano | |
| 5,450,646 | A | 9/1995 | McHugh et al. | |
| 5,454,659 | A | 10/1995 | Vosbikian et al. | |
| 5,464,477 | A | 11/1995 | Awad | |
| 5,467,492 | A | 11/1995 | Chao et al. | |
| 5,529,788 | A | 6/1996 | De Senna | |
| 5,546,624 | A | 8/1996 | Bock | |
| 5,640,960 | A | 6/1997 | Jones et al. | |
| 5,697,115 | A | 12/1997 | Sciarra et al. | |
| 5,718,014 | A | 2/1998 | DeBlois et al. | |
| 5,770,550 | A | 6/1998 | Motson | |
| 5,770,801 | A | 6/1998 | Wang et al. | |
| 5,849,039 | A | 12/1998 | Sadlowski | |
| 5,863,299 | A | 1/1999 | Holt et al. | |
| 5,872,090 | A | 2/1999 | You et al. | |
| 5,890,249 | A | 4/1999 | Hoffman | |
| 5,891,197 | A | 4/1999 | Young et al. | |
| 5,906,687 | A | 5/1999 | Masui et al. | |
| 6,004,403 | A | 12/1999 | Gray et al. | |
| 6,047,707 | A * | 4/2000 | Johnson | 132/232 |
| 6,376,444 | B1 | 4/2002 | Hortel et al. | |
| 6,391,061 | B1 | 5/2002 | Hortel et al. | |
| 6,589,294 | B1 * | 7/2003 | Hortel et al. | 8/137.5 |
| 6,624,133 | B1 * | 9/2003 | McKenzie et al. | 510/392 |
| 6,689,730 | B1 * | 2/2004 | Senapati et al. | 510/277 |
| 2001/0037537 | A1 | 11/2001 | Kitaori et al. | |
| 2002/0036444 | A1 | 3/2002 | Yamashiro et al. | |

FOREIGN PATENT DOCUMENTS

| | | | |
|---|---|---|---|
| DE | 3610386 | A1 | 10/1987 |
| DE | 197 12 401 | C1 | 5/1998 |
| EP | 128 277 | B1 | 2/1988 |
| EP | 856 277 | A1 | 8/1998 |
| FR | 1.102.562 | | 10/1955 |
| GB | 2204321 | A | 11/1988 |
| GB | 2 237 504 | A | 5/1991 |
| JP | 61-199829 | | 9/1986 |
| JP | 61-249500 | | 11/1986 |
| JP | 04-050361 | | 2/1992 |
| JP | 09-205074 | | 8/1997 |
| JP | 10-165228 | | 6/1998 |
| JP | 11-047601 | | 2/1999 |
| JP | 2000-157941 | A | 6/2000 |
| JP | 2001-113087 | A | 4/2001 |
| JP | 2001-205206 | | 7/2001 |
| JP | 2001-310094 | | 11/2001 |
| JP | 2001-310095 | | 11/2001 |
| JP | 2001-310165 | | 11/2001 |
| JP | 2002-035485 | A | 2/2002 |
| JP | 2002-102578 | A | 4/2002 |
| JP | 2002-166238 | A | 6/2002 |
| JP | 2002-186921 | A | 7/2002 |
| JP | 2002-191892 | A | 7/2002 |
| JP | 2002-191893 | A | 7/2002 |
| WO | WO 97/16263 | | 5/1997 |
| WO | WO 97/26821 | | 7/1997 |
| WO | WO 97/29178 | | 8/1997 |
| WO | WO 98/14985 | | 4/1998 |
| WO | WO 99/42553 | * | 8/1999 |
| WO | WO 00/29535 | * | 5/2000 |

* cited by examiner

ENHANCED ULTRASONIC CLEANING DEVICES

RELATED APPLICATIONS

This application claims priority to U.S. Provisional Application Ser. No. 60/330,379 filed Oct. 18, 2001.

FIELD OF THE INVENTION

The present invention is directed to ultrasonic cleaning devices for removing soils using ultrasonic waves. More particularly, the present invention is directed to ultrasonic cleaning devices which include enhancements and/or improvements facilitating the use thereof by consumers.

BACKGROUND OF THE INVENTION

Ultrasonic cleaning is a well-known cleaning process in industry. For example, ultrasonic cleaning is used to clean electronic components after or during immersion in cleaning solution such as azeotropic mixtures of fluorohydrocarbons. Ultrasonic cleaning has also been used domestically to a small extent in oral hygiene, as in ultrasonic toothbrushes.

Ultrasonic cleaning devices for domestic use in removing stains and soils from domestic surfaces, including hard surfaces and fibrous surfaces, are disclosed in U.S. Provisional Application Ser. No. 60/165,758 filed Nov. 16, 1999 and International Application PCT/US00/31431 filed Nov. 15, 2000 and in U.S. application Ser. No. 09/831,783 filed Nov. 16, 1999, all of which are incorporated herein by reference. Cleaning ingredients and compositions which provide surprising and unexpected superior cleaning when used in conjunction with ultrasonic energy are also disclosed. These ultrasonic cleaning devices provide consumers with improved means for removing soils and stains from various household items including, but not limited to, fibrous surfaces such as garments, upholsteries and other fabrics, and carpets and hard surfaces.

SUMMARY OF THE INVENTION

Accordingly, the present invention is directed to enhanced ultrasonic cleaning devices adapted to improve consumer use thereof.

In one embodiment, the invention is directed to an ultrasonic cleaning device comprising a housing; a sonotrode adapted to oscillate at an ultrasonic frequency; and an adjuster mounted on an outer surface of the device and adapted to adjust the amplitude at which the sonotrode oscillates.

In a second embodiment, the invention is directed to an ultrasonic cleaning device comprising a sonotrode adapted to oscillate at an ultrasonic frequency and having a tip adapted to contact a soiled surface, and a power source adapted to deliver current to the sonotrode, wherein the sonotrode tip has length, width and thickness dimensions, and further wherein the thickness dimension is substantially smaller than the length or width dimensions.

In a third embodiment, the invention is directed to a household cleaning appliance comprising an ultrasonic cleaning device including a sonotrode adapted to oscillate at an ultrasonic frequency, a docking station receiving the ultrasonic cleaning device, the ultrasonic cleaning device being adapted for removal from the docking station for contacting a soiled surface, and a power supply connected with the sonotrode and adapted to oscillate the sonotrode.

In a fourth embodiment, the invention is directed to an ultrasonic cleaning device comprising a housing, a sonotrode adapted to oscillate at an ultrasonic frequency and adapted to contact a soiled surface; a power supply adapted to supply current to the sonotrode; and a vacuum source adapted to remove loosened soil particles and residual cleaning composition from a surface being cleaned.

In a fifth embodiment, the invention is directed to an ultrasonic cleaning device, comprising a sonotrode adapted to oscillate at an ultrasonic frequency and having a sonotrode tip adapted to contact a surface to be cleaned, and a power source adapted to deliver current to the sonotrode, wherein the sonotrode has a pen-shaped shroud and is connected with the power supply via a cable.

In a sixth embodiment, the invention is directed to an ultrasonic cleaning device comprising a housing, a sonotrode adapted to oscillate at an ultrasonic frequency and adapted to contact a soiled surface; a power supply adapted to supply current to the sonotrode; and a plurality of interchangeable sonotrode tips.

In a seventh embodiment, the invention is directed to an ultrasonic cleaning device comprising a housing, a sonotrode including a shroud and a tip, wherein the sonotrode is adapted to oscillate at an ultrasonic frequency and adapted to contact a soiled surface; and a power supply adapted to supply current to the sonotrode; wherein the shroud has a configuration adapted to facilitate optimal positioning of the sonotrode tip with respect to a soiled surface to optimize a cleaning effect.

In an eighth embodiment, the invention is directed to an ultrasonic cleaning device comprising an ultrasonic sonotrode including a spherically shaped tip portion adapted to contact a soiled surface.

In a ninth embodiment, the invention is directed to a hand held ultrasonic cleaning device comprising a housing, a handle mounted on an outer surface of the housing, a sonotrode adapted to oscillate at an ultrasonic frequency and adapted to contact a soiled surface; and a power supply adapted to supply current to the sonotrode.

In a tenth embodiment, the invention is directed to an ultrasonic cleaning device comprising a housing, a sonotrode adapted to oscillate at an ultrasonic frequency and adapted to contact a soiled surface; a power supply adapted to supply current to the sonotrode; and an indicator light adapted for lighting to indicate a condition of the device to an operator thereof.

In an eleventh embodiment, the invention is directed to an ultrasonic cleaning device comprising a housing, a sonotrode adapted to oscillate at an ultrasonic frequency and adapted to contact a soiled surface; a power supply adapted to supply current to the sonotrode; a first reservoir of a first ultrasonic cleaning composition; and a second reservoir of a second ultrasonic cleaning composition; wherein the ultrasonic cleaning device is adapted to permit controlled dispensing of an ultrasonic cleaning composition to a soiled surface while concurrently imparting ultrasonic waves thereto via the sonotrode, and wherein the ultrasonic cleaning device further comprises a selector for selecting which ultrasonic cleaning composition is to be dispensed to a soiled surface.

In a twelfth embodiment, the invention is directed to an ultrasonic cleaning device comprising a housing, a sonotrode adapted to oscillate at an ultrasonic frequency and adapted to contact a soiled fabric surface; an adjustable power supply adapted to supply alternating current to the sonotrode; and instructions for adjusting the power supply relative to a type of fabric surface to be cleaned.

In a thirteenth embodiment, the invention is directed to an ultrasonic cleaning device comprising a housing, a sonotrode adapted to oscillate at an ultrasonic frequency and adapted to contact a soiled surface; a power supply adapted to supply current to the sonotrode; and instructions for optimal positioning of the sonotrode with respect to a soiled surface to optimize a cleaning effect.

In a fourteenth embodiment, the invention is directed to an ultrasonic cleaning device comprising a housing, a sonotrode adapted to oscillate at an ultrasonic frequency and adapted to contact a soiled surface; a power supply adapted to supply current to the sonotrode; and instructions including nonverbal cues for operation of the device.

The various embodiments of the ultrasonic cleaning devices according to the present invention include features which facilitate use of the ultrasonic cleaning devices by consumers, improve the safety of the ultrasonic cleaning devices when used by consumers, and/or improve the cleaning efficiency of the ultrasonic cleaning devices when used by consumers. These and additional objects and advantages will be more fully apparent in view of the following detailed description.

BRIEF DESCRIPTION OF THE DRAWINGS

The following detailed description will be more fully understood in view of the drawing in which.

Figure 1:
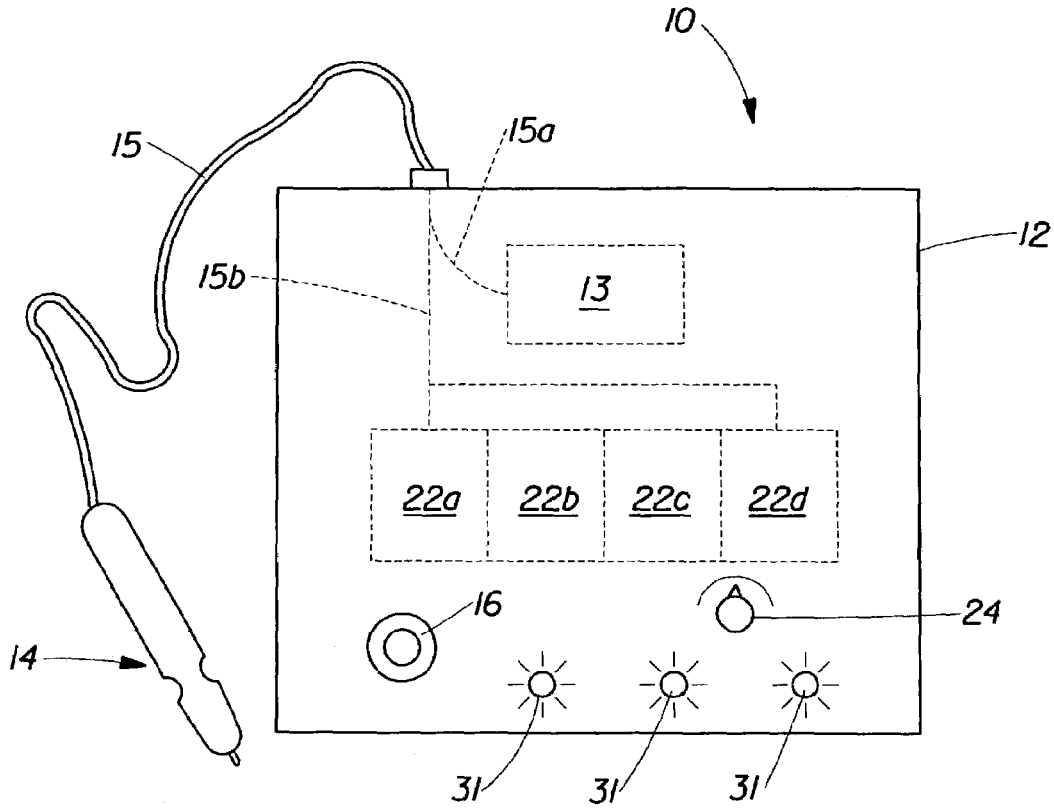
FIG. 1 sets forth a schematic diagram of one embodiment of an ultrasonic cleaning device according to the invention.

The embodiments set forth in the drawing are illustrative in nature and are not intended to be limiting of the invention defined by the claims. Moreover, individual features of the drawing and the invention will be more fully apparent and understood in view of the detailed description.

DETAILED DESCRIPTION

The present invention is directed to ultrasonic cleaning devices which include enhancements for facilitating use by consumers, for improving safety of the devices for use by consumers and/or for improving cleaning performance and/or efficiency of the devices.

As used herein, the phrase "ultrasonic" cleaning refers to cleaning processes or devices employing ultrasonic waves, i.e. longitudinal waves with frequency above the audible range, wherein the frequency spectra of these waves can vary from about 16 kHz to 10 MHz.

The ultrasonic cleaning devices can be utilized for both hard domestic surfaces and fibrous surfaces. A "fibrous surface" includes any fabric surface, such as clothing, including but not limited to, shirts, pants, dresses, skirts, blouses, gloves, hats and shoes; upholstery, such as furniture and car seats; linens, curtains, drapes, carpets, rugs, tapestries, pads, wipes, etc. The "fibrous surface" can be, for example, composed of natural fibers such as cotton, wool or silk; artificial fibers, such as polyesters, rayon or dacron; or blends of natural and artificial fibers, such as polycotton blends. A "hard domestic surface", includes any surface which is traditionally regarded as an inanimate hard surface in a domestic environment, such as, tableware, plates, glasses, cutlery, pots and pans, and also includes other surfaces such as kitchen counter tops, sinks, glass, windows, enamel surfaces, metal surfaces, tiles, bathtubs, walls, ceilings, floors, etc. Indeed, use of devices according to the invention significantly improve the removal of domestic stains due to food, grass, greasy materials or body soils, for example, on various surfaces.

As is known in the art, an ultrasonic sonotrode generates ultrasonic waves by application of a voltage across a ceramic material, also referred to as a piezoelectric crystalline material or PZT. The voltage is applied as an alternating or direct current at a desired oscillation frequency and causes movement of the ceramic material. The ceramic material is coupled to a transducer which typically comprises a converter section and a horn section which amplify the motion of the ceramic material. The horn includes a tip, referred to herein as a sonotrode tip, for contact with a soiled surface. The assembly of the ceramic material, converter and horn, including the tip, is commonly referred to herein as the sonotrode, with the housing for these elements being referred to as the sonotrode shroud.

While not intending to be limited by theory, it is believed that the ultrasonic energy enhances cleaning via provoking cavitation and generating heat. Cavitation is a well-described phenomenon in the study of liquids. It is the repeated formation and implosion of microscopic bubbles, causing high-pressure shock waves in a liquid and locally generating extremely high temperatures. Heat is also generated by absorption of acoustic energy by the ceramic material, the converter, the horn, a surface to be cleaned, a soil and a liquid cleaning composition. This absorption can also be defined as internal friction, and occurs concurrently with heat-generating frictions at the interfaces of the different materials described above. While not intending to be limited by theory, it is believed that ultrasonic energy via cavitation and heat improves rehydration and softening of soil and hence makes it easier to clean. It is believed to do this by increasing the penetration rate of a cleaning solution into soil via the generation of shock waves as described above.

These shock waves, locally combined with heat, break the adhesive bonds between the soil and the substrate. The friction heat and the cavitation heat can also both activate specific chemistry (e.g. heat-activated bleach) and hence significantly improve cleaning.

By using the present ultrasonic devices, soils and stains can be removed without manually or macroscopically using excessive force, rubbing, pressure or other manipulation which causes wear and tear on the stained material or surface. In doing so, the user does not need to impart such manual energy to remove the soils or stains, thereby adding to the convenience of the user.

Throughout the present specification and claims, reference to soil or soiled surfaces refers to and includes soil, soiled surfaces, stains, stained surfaces, and/or surfaces to be cleaned.

The ultrasonic cleaning devices according to the present invention comprise a sonotrode adapted to oscillate at an ultrasonic frequency. For example, FIG. 1 sets forth a schematic diagram of an ultrasonic cleaning device according to the present invention. The device 10 includes a housing 12 and a sonotrode 14. A power supply 13 is housed within the housing 12, and therefore is shown in phantom in FIG. 1, and power s the sonotrode by supplying current thereto. The sonotrode is connected with the power supply in the embodiment of FIG. 1 via a cable 15, specifically at 15*a*. As noted above, the oscillating frequency of the sonotrode may range from a few cycles per second to a few billion cycles per second. Typically, the sonotrode is adapted to oscillate at a frequency of from about 10 kHz to about 100 kHz. In more specific embodiments, the sonotrode is adapted to oscillate at a frequency of from about 25 kHz to about 50 kHz, and more specifically, from about 30 kHz to about 50 kHz.

In one embodiment, the ultrasonic cleaning device is provided with an adjuster for adjusting the amplitude at which the sonotrode oscillates. For example, the amplitude adjuster may comprise a potentiometer adapted to regulate power delivered to the sonotrode, and thereby regulate the amplitude at which the sonotrode oscillates. Additional means for adjusting the amplitude at which the sonotrode oscillates will be apparent to those skilled in the art in view of the present specification. In one embodiment, the amplitude adjuster is mounted on an outer surface of the ultrasonic cleaning device in order to facilitate adjustment by a consumer using the device. As shown in FIG. 1*a*, the amplitude adjuster may comprise a dial 16 mounted on the outer surface of the housing 12 or, alternatively, may comprise a dial 18 mounted on a shroud 20 of the sonotrode and therefore adjacent to the sonotrode tip 17.

The amplitude at which the sonotrode oscillates can be selected in view of the intended use of the device. In one embodiment, it is preferred that the amplitude is adjustable in a range of from about 1 micron to about 100 microns, more specifically in a range of from about 10 microns to about 50 microns, and yet more specifically in a range of from about 20 microns to about 30 microns. Amplitudes of higher values are suitable for obtaining good cleaning of sturdier substrates, for example hard surfaces, carpets, shoes, sofas and the like, while amplitudes at the lower end of these ranges are preferred for more delicate substrates, including garment fabrics such as denim, rayon and the like. Similarly, more difficult or deep soils may be cleaned using higher amplitudes while lighter or surface soils may be cleaned using lower amplitudes. Thus, the amplitude adjuster in the ultrasonic cleaning device of the present invention allows the consumer to customize the amplitude which is employed in the ultrasonic cleaning dependent on the substrate and/or soil to be cleaned. This allows the consumer to avoid damaging delicate substrates while obtaining good, deep cleaning on sturdier substrates or difficult soils.

In a more specific embodiment, the amplitude adjuster may be provided with a feedback system which is adapted to maintain the amplitude of the sonotrode oscillation during operation or as power is regulated. For example, the pressure applied to the tip of the sonotrode which contacts the soiled surface may tend to cause the amplitude of the sonotrode to vary. Accordingly, the feedback system will adjust the power in order to maintain the amplitude substantially constant during operation of the device. Such feedback systems comprising a phase lock amplifier or the like are well known in the electrical arts and may be employed herein.

In one embodiment, the ultrasonic cleaning device comprises at least one reservoir of an ultrasonic cleaning composition and a delivery system for delivering the ultrasonic cleaning composition to a soiled surface to be cleaned with the device. Compositions suitable for use in ultrasonic cleaning devices as disclosed herein are set forth in detail in copending application Ser. No. 09/831,783 filed Nov. 16, 1999. In further embodiments, the ultrasonic cleaning device comprises at least two reservoirs of ultrasonic cleaning compositions, which compositions are adapted for particular cleaning applications. For example, in one embodiment, a first reservoir is provided with an ultrasonic cleaning composition adapted for wet cleaning, such as aqueous laundry applications, while a second reservoir is provided with an ultrasonic cleaning composition which is adapted for dry cleaning applications. In further embodiments, individual reservoirs of cleaning compositions can be provided which are particularly adapted for delicate fabrics such as silk or rayon, natural fabrics such as cotton, and/or sturdier fabrics such as carpets or upholstery, respectively. Thus, the ultrasonic cleaning device may be provided with a selector for selecting among the different reservoirs of ultrasonic cleaning compositions for supply to the soiled surface.

Figure 1A:
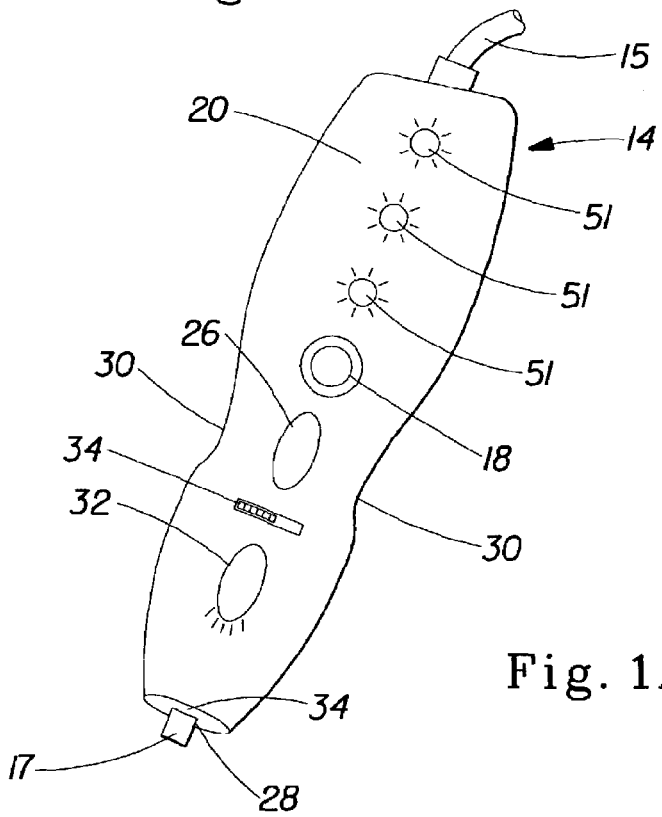
FIG. 1*a* sets forth an enlarged perspective view of the sonotrode set forth in the embodiment of FIG. 1.

For example, in the embodiment of FIG. 1, the ultrasonic cleaning device includes reservoirs 22*a*, 22*b*, 22*c* and 22*d* respectively containing four different ultrasonic cleaning compositions, housed within housing 12 and therefore shown in phantom. A selector 24 is provided for selecting among the individual reservoirs to supply a particular ultrasonic cleaning composition for a desired substrate. As shown in FIG. 1, the reservoirs 22*a*–22*d* are connected with the sonotrode 14 via cable 15. Thus, cable 15 is preferably a dual cable providing electrical connection between the power supply 13 and the sonotrode 14 and providing liquid communication between the reservoirs 22*a*–22*d* via portion 15*b* of the cable. Accordingly, movement of the selector 24 will control valving in the cable portion 15*b* to open a selected one of the reservoirs 22*a*–22*d* and close the remaining reservoirs, thereby allowing ultrasonic cleaning composition to flow from the open reservoir through cable 15*b* to the sonotrode 14. As shown in FIG. 1*a*, the sonotrode is provided with an outlet 28 for dispensing the ultrasonic cleaning composition to a surface to be cleaned.

In a further embodiment, the ultrasonic cleaning device is adapted to permit controlled dispensing of the ultrasonic cleaning composition as required by the user from a reservoir to a soiled surface in need of cleaning, while concurrently imparting ultrasonic waves thereto via the sonotrode. For example, as shown in FIG. 1, the sonotrode 14 is provided with dispensing actuator 26 in order to dispense the ultrasonic cleaning composition from a selected reservoir as desired by a user, through cable 15 and adjacent the sonotrode tip via the outlet 28.

One skilled in the art will appreciate that sonotrodes of other, different configurations may be provided in the devices of the invention. For example, the sonotrode shroud may include a rechargeable power supply and/or a refillable reservoir for containing ultrasonic cleaning composition, whereby cable connection to a power supply and/or cleaning fluid reservoir is not required.

While the sonotrode which is employed in the ultrasonic cleaning devices according to the invention may have any shape, size or configuration, in a preferred embodiment, the sonotrode 14 comprises a shroud which is in the shape of a pen as shown in FIG. 1 which therefore facilitates comfortable and convenient positioning by the consumer. Attention is directed to FIG. 1*a* which discloses a more detailed perspective view of an exemplary embodiment of a pen-shaped shroud according to the invention. More specifically, the pen-shaped shroud 20 includes configurations 30 adapted to comfortably receive a user's fingers in the same manner in which a user would hold a writing pen. The configurations 30 allow a consumer to comfortably grip the sonotrode in a familiar manner. Additionally, the configurations 30 of the pen-shaped shroud 20 are preferably adapted to facilitate optimal positioning of the sonotrode tip with respect to a stained surface to optimize a cleaning effect. In one embodiment, it is preferred that the sonotrode tip be positioned substantially perpendicular with respect to the surface which is to be cleaned. Thus, it is preferred that the shroud is configured to adapt a user to hold the sonotrode tip at an angle of from about 45 to about 135 degrees, more specifically from about 70 to about 110 degrees, with respect to the stained surface.

Figure 2A:
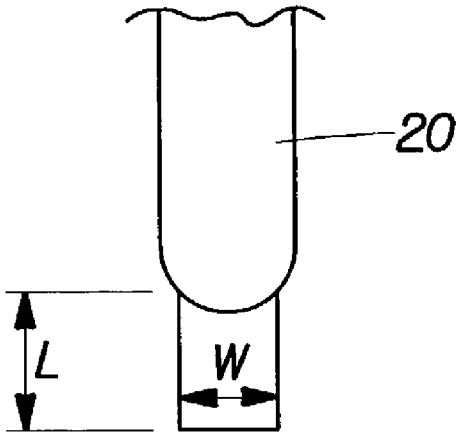
FIGS. 2*a* and 2*b* set forth the schematic diagram of one embodiment of a sonotrode according to the present invention.
Figure 2B:
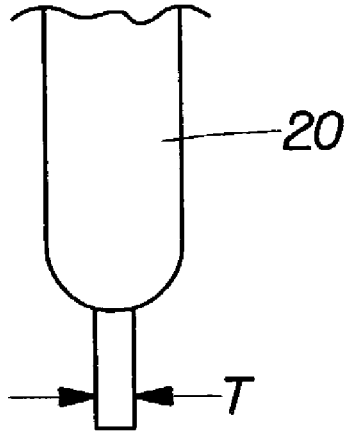

In further embodiments of the invention, the ultrasonic cleaning device comprises a sonotrode tip of particular geometric configurations. In one embodiment, the sonotrode tip has length, width and thickness dimensions, wherein the thickness dimension is smaller than the length or width dimensions. In this embodiment, wherein the sonotrode tip has a thickness dimension which is substantially smaller than the length or width dimensions, the surface area of the sonotrode tip adapted for contact with a soiled surface is increased. While not intending to be limited by theory, it is believed that there is a direct correlation between the sonotrode tip contact surface area and sonotrode amplitude for a fixed power setting, converter and piezoelectric crystalline material. Thus, a sonotrode tip as described provides good cleaning ability at relatively lower power settings. This is particularly advantageous for obtaining good cleaning of delicate fabrics which could be damaged at higher power settings. In one embodiment, the sonotrode tip having the described geometry has a blade shape, for example as set forth schematically in the front and side views of FIGS. 2*a* and 2*b*. As is apparent, the length L and width W of the blade-shaped sonotrode tip as shown in FIG. 2*a* are greater as compared to the smallest dimension, which is called the thickness T as shown in FIG. 2*b*. Preferably, the thickness of the sonotrode tip is less than 3 mm, more preferably less than 2 mm and most preferably not greater than 1 mm.

Figure 2C:
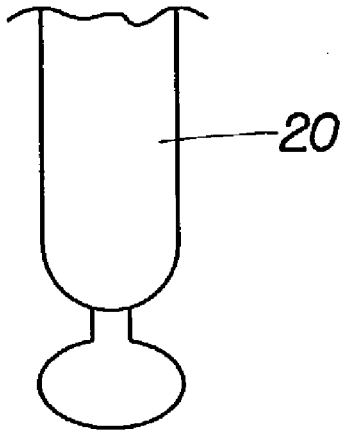
FIGS. 2*c* and 2*d* set forth schematic diagrams of two additional embodiments of sonotrode tips according to the invention.
Figure 2D:
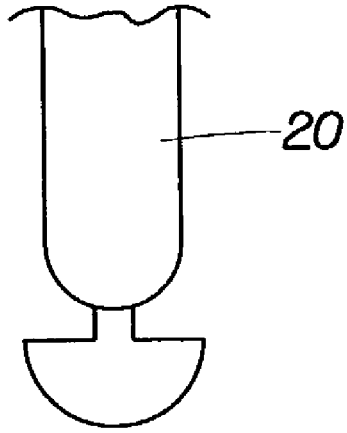

In a further embodiment of the ultrasonic cleaning device of the invention, the ultrasonic sonotrode includes a spherically-shaped tip portion. Exemplary spherically-shaped tips are disclosed in FIGS. 2*c* and 2*d*. The embodiment of FIG. 2*c* comprises a substantially full sphere while the embodiment of FIG. 2*d* comprises a semi-sphere. The spherical shape of these sonotrode tips facilitates orientation of the tip substantially perpendicularly to a surface to be cleaned. Additionally, as the spherical-shaped sonotrode tip is vibrated, the tip will expand in a radial direction and therefore will heat faster as compared with sonotrode tips of other geometries. As more energy is dissipated into heat, the chemistry of ultrasonic cleaning compositions used in combination therewith will be more quickly activated. For example, ultrasonic cleaning compositions which employ heat-activated bleach components may be advantageously used in combination with the spherically-shaped sonotrode tip in order to provide faster and improved bleachable soil and stain removal. Thus, the spherical sonotrode tip provides improved ultrasonic cleaning.

The spherically-shaped sonotrode tip may be formed from a variety of materials including, for example, stainless steel, which is a conventional material used for sonotrode tips. Advantageously, the spherically-shaped sonotrode tip may be formed of other, more easily shaped materials such as aluminum, tungsten, brass or the like. While aluminum is not usually a material of choice in forming sonotrode tips of other geometrical shapes because it does not heat sufficiently fast enough to provide desirable cleaning effects, it has surprisingly been found that the spherically-shaped sonotrode tip can be formed of aluminum as the spherical shape provides sufficiently fast heating of the aluminum to allow practical use. Because the spherically-shaped configuration of the sonotrode tip of this embodiment provides faster heating, the sonotrode tip may be of a smaller size as compared with other geometrical tip configurations in order to provide a particular heating requirement. Additionally, one skilled in the art will recognize that a sonotrode tip formed of aluminum is advantageous in that aluminum is less expensive than stainless steel or tungsten and is less expensive to process into a desired shape.

The sonotrode tips employed in the ultrasonic cleaning devices according to the invention may include one or more coatings in order to improve the cleaning process and/or protect the sonotrode tip. Suitable coatings include, but are not limited to, coatings comprising chromium, nickel, iron, cadmium, copper, brass or mixtures thereof, or an organic coating material such as Teflon®, or the like.

Optionally, either the housing 12 and/or the sonotrode 14 may include one or more indicator lights 31 for selected illumination during operation of the device. For example, one of the indicator lights 31 may be illuminated to indicate that power is being supplied to the sonotrode 14. In another embodiment, one of the indicator lights 31 may be selectively illuminated when a reservoir of ultrasonic cleaning composition in fluid communication with the sonotrode is reduced to a predetermined level. Additionally, one of the indicator lights 31 may be selectively illuminated in the event or a malfunction of the device. The indicator lights may comprise bulbs, light emitting diodes (led's), or the like.

The ultrasonic cleaning device may further include a light adapted to illuminate a stained surface. For example, in the embodiment of FIG. 1*a*, the pen-shaped shroud 20 of the sonotrode 14 includes a light 32 which is adapted to illuminate a surface contacted by the sonotrode tip 17. In one embodiment, the light 32 may be selectively activated by the user by movement of a switch 34 provided on the sonotrode shroud as shown in FIG. 1*a*. Alternatively, the light 32 may be automatically switched on any time power is delivered to the sonotrode.

In a further embodiment, the ultrasonic cleaning device according to the invention comprises a sonotrode having a plurality of interchangeable sonotrode tips. For example, as shown in FIGS. 5*a*–5*f*, a plurality of sonotrode tips may be provided wherein each tip includes a connector 300 for connecting the sonotrode tip to the remaining portion of the sonotrode. Preferably, the sonotrode shroud is pen-shaped as described above and includes means for releasably locking respective sonotrode tips therein. Suitable connectors will be apparent to one of ordinary skill in the art and the particular configurations thereof are not critical to the ultrasonic cleaning devices of the invention. As examples, the connector may comprise screw threads, locking grips, or the like. As shown in FIGS. 5*a*–5*f*, the sonotrode tips may vary in shape and/or size in order to accommodate the use of the ultrasonic cleaning device to clean a variety of substrates and/or in order to clean a variety of soil types from such substrates.

In a further embodiment, the sonotrode is provided with a temperature sensor 34, for example a thermocouple, which is adapted to sense the temperature of the piezoelectric crystal. The temperature sensor is coupled to a switch (not shown) which is adapted to interrupt delivery of current from the power supply 13 to the sonotrode 14 if the temperature of the piezoelectric crystal is sensed as greater than a preset maximum allowable temperature. For example, the sensor 34 and the switch may be adjusted to interrupt delivery of current from the power supply to the sonotrode if the temperature of the piezoelectric crystal is sensed as greater than about 90° C., more specifically greater than about 80° C., or even more specifically greater than about 70° C.

In a further embodiment, the present invention is directed to household cleaning appliances which comprise an ultrasonic cleaning device. More specifically, a household cleaning appliance according to the invention comprises an ultrasonic cleaning device including a sonotrode adapted to oscillate at an ultrasonic frequency, a docking station receiving the ultrasonic cleaning device, the ultrasonic cleaning device being adapted for removal from the docking station for contacting a soiled surface, and a power supply connected with the sonotrode and adapted to oscillate the sonotrode. The power supply may be permanently mounted within the household cleaning appliance or may be removable from the docking station together with the sonotrode.

Figure 3A:
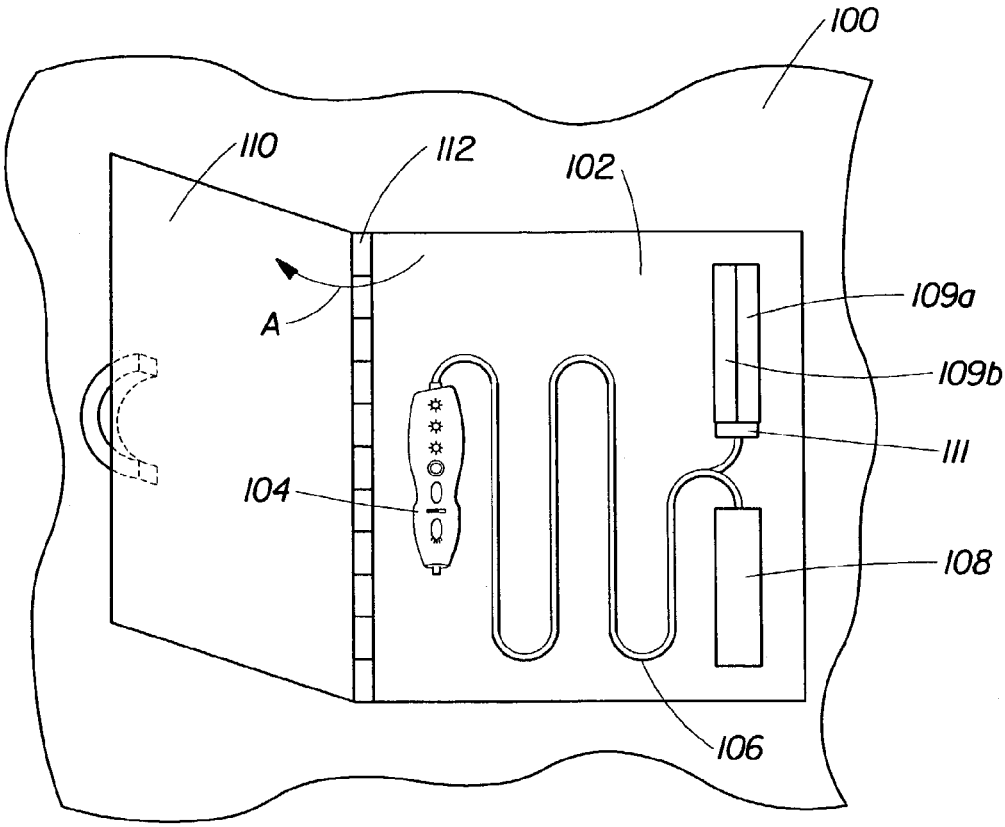
FIG. 3*a* sets forth a first embodiment of an ultrasonic cleaning device in combination with a docking station provided on a household cleaning appliance according to the present invention.

A first exemplary embodiment of a household cleaning appliance is set forth in FIG. 3*a*. With reference to FIG. 3*a*, the household appliance is only partially shown at 100 and includes a recessed docking station 102 receiving a pen-shaped sonotrode 104 and a dual cable 106 which electrically connects the sonotrode to a power supply 108 and connects the sonotrode in fluid communication to ultrasonic cleaning composition reservoirs 109*a* and 109*b*. A selector 111 in the form of a switch is provided to select among the reservoirs 109*a* and 109*b* for supplying the respective cleaning compositions to the sonotrode 104. In the embodiment shown in FIG. 3*a*, the sonotrode having the pen shape and size has a relatively sleek design, whereby the docking station may be configured relatively compactly. The cable may be of any desired length to allow convenient use of the sonotrode by a consumer.

Figure 3B:
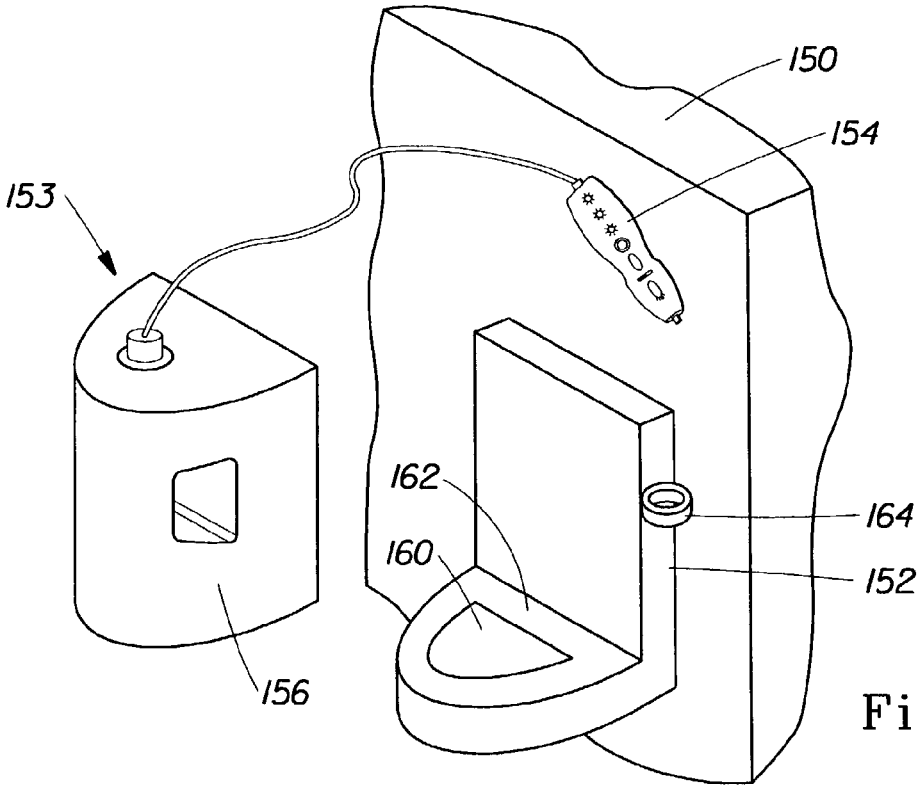
FIG. 3*b* sets forth a second embodiment of an ultrasonic cleaning device in combination with a docking station provided on a household cleaning appliance according to the invention.

One skilled in the art will appreciate that sonotrodes of other, different configurations may be provided in this embodiment. For example, FIG. 3*b* shows a second exemplary embodiment of a household cleaning appliance of the invention. The appliance 150 includes an externally mounted docking station 152 receiving an ultrasonic cleaning device 153 including a pen-shaped sonotrode 154. The ultrasonic cleaning device 153 further includes a housing 156 having a rechargeable power supply (not shown) therein and/or a refillable reservoir (not shown) therein for containing a cleaning composition. A cable 158 provides electrical connection to the sonotrode 154 from the power supply and/or fluid connection to the sonotrode from the cleaning fluid reservoir within the housing 156. Additionally, the docking station may be provided with a recharging port 160 for recharging a rechargeable power supply contained in the housing. As will be apparent from FIG. 3*b*, the housing 156 may rest on a surface 162 of the docking system, whereby recharging from the port 160 to a mating port (not shown) on the housing 156 and in connection with the rechargeable power supply may be achieved. The sonotrode 154 may be placed on a holding ring 164 to provide convenient access to the sonotrode and/or to avoid damage of the sonotrode in the docking station.

Integration of the ultrasonic cleaning device into the household appliance allows convenient use of the ultrasonic cleaning device in combination with other cleaning techniques provided by the household cleaning appliance. For example, the ultrasonic cleaning device and docking station may be provided in a household garment care device such as a laundry washing machine, a dryer, an ironing table or a garment press in order to allow a consumer to remove stains or soil while simultaneously washing, drying or pressing garments. For example, the consumer can easily use the ultrasonic cleaning device for pre-treatment of soils or stains before a garment is placed in the washing machine. Such integration is particularly advantageous in a laundry washing machine as consumers typically inspect garments as they are filling and/or emptying the washing machine. Alternatively, the ultrasonic cleaning device and docking station may be provided in combination with an automatic dishwasher to allow removal of tableware and dish stains or soil prior to washing of such articles in the automatic dishwasher. In yet a further embodiment, the ultrasonic cleaning device and docking station are provided in a household vacuum, whereby a consumer may use the ultrasonic cleaning device to clean upholstery, carpets, drapes and the like during regular household vacuuming. As the details of such conventional household appliances are known in the respective arts, further details of such appliances are not provided herein.

The docking station 102 may optionally include a cover or door for opening and closing the docking station. As shown in FIG. 3*a*, a door 111 is provided on hinges 112 to open in the direction of the arrow A and afford access to the docking station. One skilled in the art will appreciate that additional doors or covers for the docking station may be employed. For example, the covering may be slidable from a closed, covering position to an open position to afford access to the sonotrode therein.

Figure 4A:
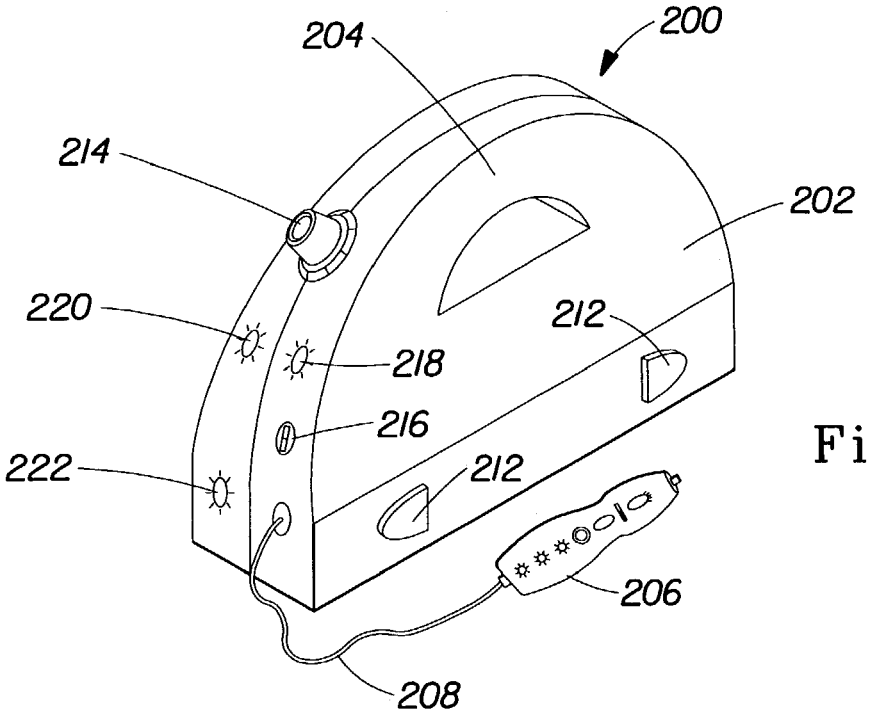
FIG. 4*a* is a front perspective view of an embodiment of a hand held ultrasonic cleaning device according to the invention including an integral handle.
Figure 4B:
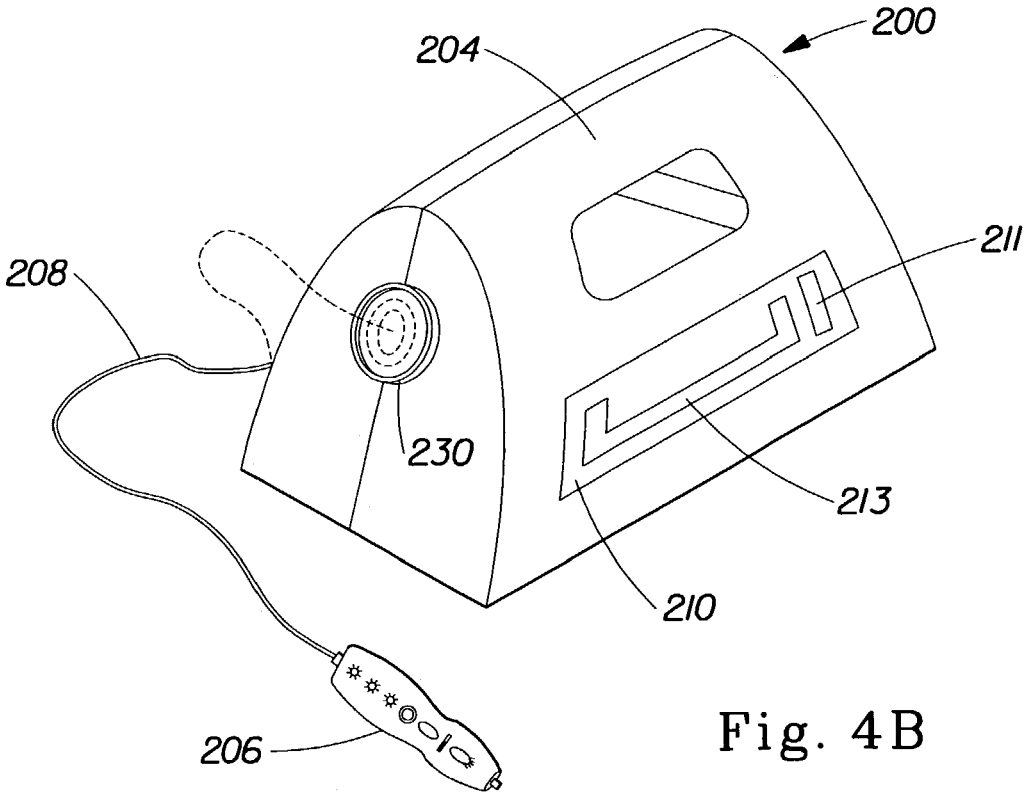
FIG. 4*b* is a rear perspective view of the hand held ultrasonic cleaning device shown in FIG. 4*a;*
Figure 5A:
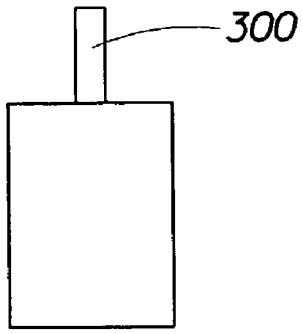
FIGS. 5*a*–5*f* are schematic diagrams of a plurality of interchangeable sonotrode tips included in an embodiment of the ultrasonic cleaning device according to the invention.
Figure 5B:
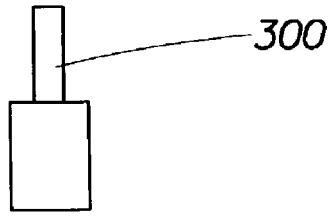
Figure 5C:
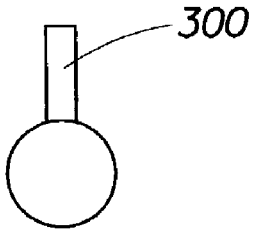
Figure 5D:
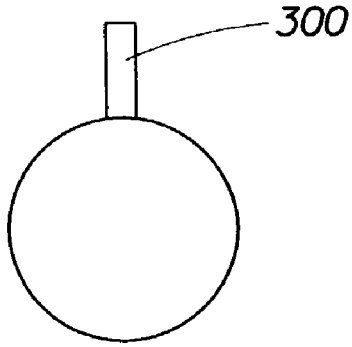
Figure 5E:
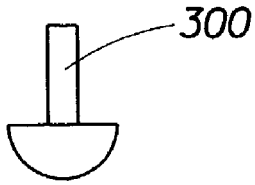
Figure 5F:
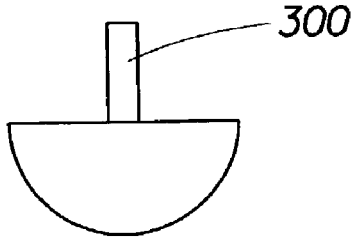

In a further embodiment, the ultrasonic cleaning device comprises a hand held device including a housing and a handle on an outer surface of the housing. The ultrasonic cleaning device further includes a sonotrode and a power supply encompassed by any of the embodiments as discussed above. Exemplary embodiments of a hand held ultrasonic cleaning device are set forth in FIGS. 4*a* and 4*b*. FIG. 4*a* is a front perspective view of a hand held ultrasonic cleaning device 200 while FIG. 4*b* is a rear perspective view of the hand held cleaning device 200. As shown in FIGS. 4*a* and 4*b*, the hand held cleaning device 200 includes a housing 202 and a handle 204 on an outer surface of the housing. In a preferred embodiment, the handle 204 is integrally molded with the housing 202 on an upper portion thereof and has a configuration which allows a consumer to easily grasp the handle and transport the ultrasonic cleaning device. The housing may be formed of any suitable material, and in a specific embodiment is formed of molded plastic. To facilitate transport by consumers, it is preferred that the ultrasonic cleaning device is compact and lightweight, and preferably weighs less than about 8 pounds.

In the embodiment of FIGS. 4*a* and 4*b*, the ultrasonic cleaning device includes a sonotrode 206 connected with a power supply (not shown) internally housed within the housing 202. To facilitate provision of a light weight device, the power supply housed within the housing 202 may comprise an electronic step up transformer. A cable of suitable length 208 connects the sonotrode with the power supply. In a preferred embodiment, the cable 208 comprises a dual cable and not only electrically connects the sonotrode with the power supply but also fluid connects the sonotrode with one or more reservoirs of ultrasonic cleaning compositions housed within the housing 202. A panel 210 is provided with a window 211 which conveniently allows a user to monitor the level of cleaning composition within the reservoir. Preferably, the reservoirs are refillable or comprise replaceable cartridges, with access to the reservoirs being provided through the panel 210. Conveniently, the panel 210 is provided with a handle 213 to facilitate removal or opening of the panel 210 for access to the reservoir of cleaning composition, shown in FIG. 4*b*.

Figure 7:
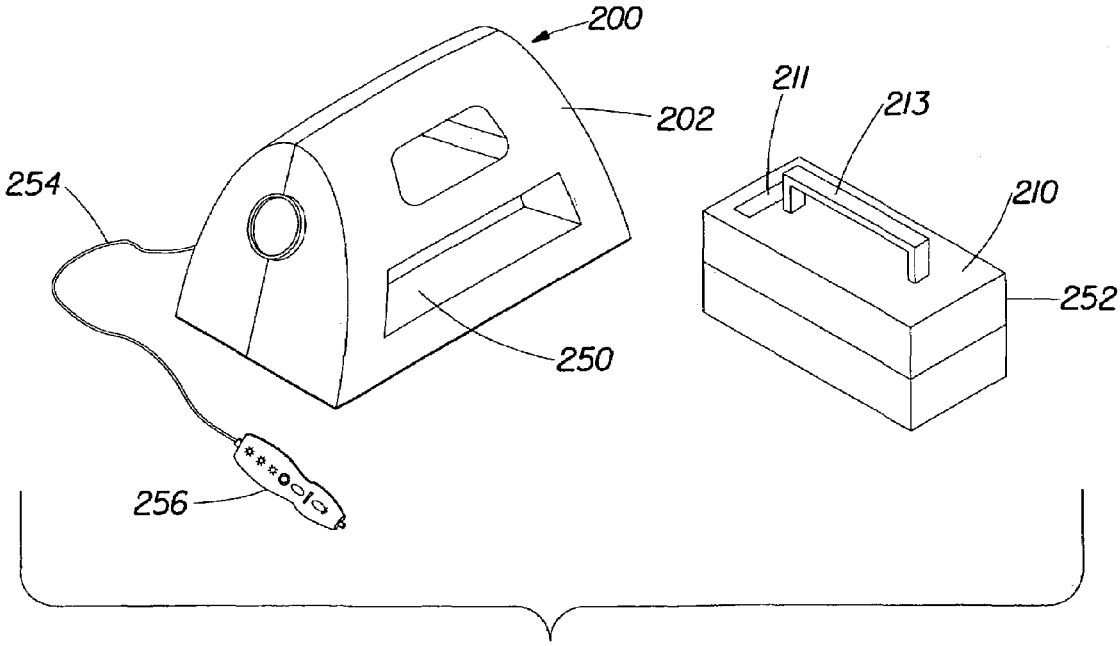
FIG. 7 sets forth a schematic diagram of an ultrasonic cleaning device according to the invention including a removable and replaceable cleaning composition reservoir.

One embodiment of a refillable reservoir is shown in FIG. 7. The ultrasonic cleaning device 200 including the housing 202 is provided with a cavity 250 for receiving a refillable reservoir 252 of cleaning composition. As shown in FIG. 7, the top surface of the reservoir 252 comprises the panel 210 shown in FIG. 4*b*, provided with the window 211 and the handle 213. The reservoir 252 may be rotated from the upright position shown in FIG. 7 and inserted in the recess 250 so that the panel 210 is flush with the adjacent outer surface of the housing 202. Upon insertion into the recess 250, the reservoir is connected in fluid communication with the cable 254 to supply the cleaning composition to the sonotrode 256.

As shown in FIG. 4*b*, the housing 202 of the ultrasonic cleaning device preferably includes a receptacle 230 adapted for receiving the sonotrode when the ultrasonic cleaning device is not in use. The phantom lines in FIG. 4*b* show a sonotrode received within the receptacle 230. The receptacle 230 is preferably dimensioned slightly larger than the dimensions of the sonotrode in order to easily receive the sonotrode therein while preventing unintentional displacement of the sonotrode from the receptacle during transport of the ultrasonic cleaning device. Conveniently, cable holders 212, 212 may be provided on the housing 202 and on which the cable 208 may be wrapped during storage of the device.

In a preferred embodiment as shown in FIG. 4*a*, an amplitude adjuster 214 comprising an adjustable dial is provided on the housing 202 to facilitate adjustment of the amplitude at which the sonotrode oscillates during ultrasonic cleaning, as discussed above. As also shown in FIG. 4*a*, the housing may be further provided with an on/off power switch 216 and one or more indicator lights 218, 220 which are adapted for illumination to indicate condition of the ultrasonic cleaning device to an operator. The indicator lights 218, 220 may be formed of light-emitting diodes, light bulbs, or other light indicators known in the art. In one embodiment, the indicator light 218 is illuminated when the power switch 216 is in the on position to indicate to the consumer that power is being supplied to the sonotrode. In an additional preferred embodiment, the light indicator 220 is illuminated when the content of an ultrasonic cleaning composition reservoir to which the sonotrode is connected via cable 208 is low or empty. This light indicator may be arranged adjacent a liquid level indicator, for example the window 211 shown in FIG. 4*b*. In a further embodiment, indicator light 222 is illuminated when the ultrasonic cleaning device is malfunctioning. In yet a further embodiment, the ultrasonic cleaning device may be provided with a switch (not shown) which is adapted to interrupt the supply of current to the sonotrode if the ultrasonic cleaning composition reservoir to which the sonotrode is connected via the cable 208 is emptied during use of the ultrasonic cleaning device. Thus, the safety switch allows the ultrasonic cleaning device to be powered only when ultrasonic cleaning composition is available for supply to the sonotrode.

Figure 6:
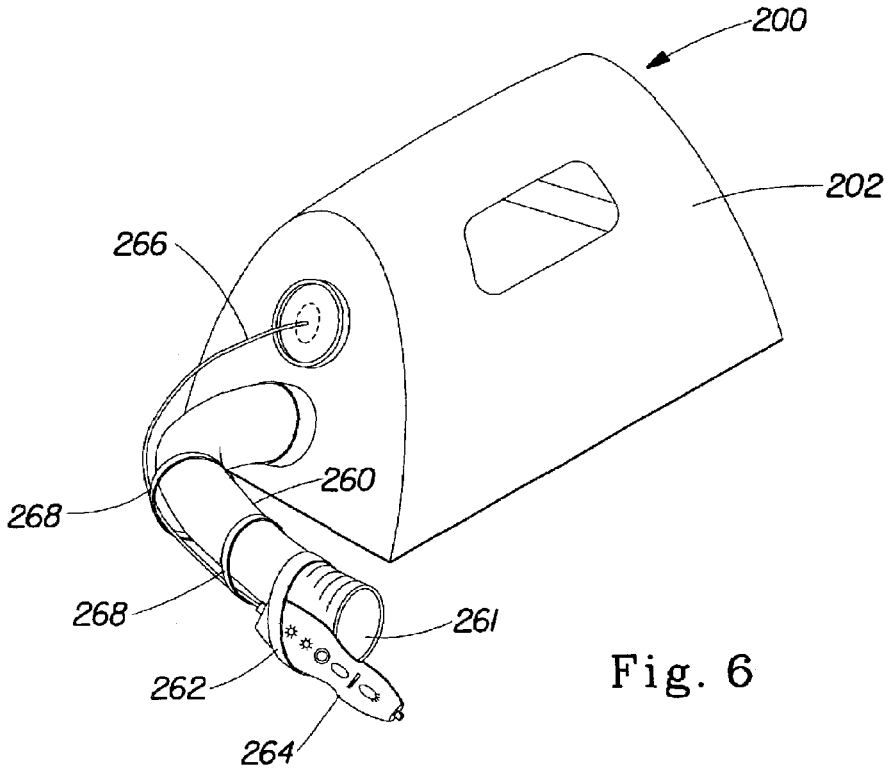
FIG. 6 sets forth an embodiment of the ultrasonic cleaning device according to the invention including a vacuum source.

In a further embodiment, the ultrasonic cleaning device according to the invention comprises a housing, a sonotrode, a power supply and a vacuum source which is adapted to remove loosened stained particles and/or residual cleaning composition from a surface being cleaned. In this embodiment, the ultrasonic cleaning device may be part of a conventional household vacuum appliance as discussed in detail above or, alternatively, a relatively small vacuum source may be provided in the ultrasonic cleaning device housing. An exemplary embodiment of such an ultrasonic cleaning device is set forth in FIG. 6. With reference to FIG. 6, the ultrasonic cleaning device 200 is provided with a housing 202 which not only includes a power source but also a vacuum source. The vacuum source (not shown) is connected with a hose 260 extending from the housing 202 for collecting soil, for example particulate soil, from a surface being cleaned and transferring the collected soil to a receptacle at the vacuum source. Any vacuum source known in the art may be employed in this embodiment, and preferably a compact vacuum source of the type employed in portable vacuums is employed. In order to maintain the inlet 261 of the hose in proximity to the surface being cleaned, the hose may be attached to a sonotrode 264 by way of elastic bands 262 or the like. Similarly, in order to prevent tanglement of the hose 260 with the cable 266 which connects the sonotrode 264 with a power supply and/or cleaning composition reservoir within the housing 202, additional elastic band connectors 268 or other connectors known in the art may be employed.

Figure 8A:
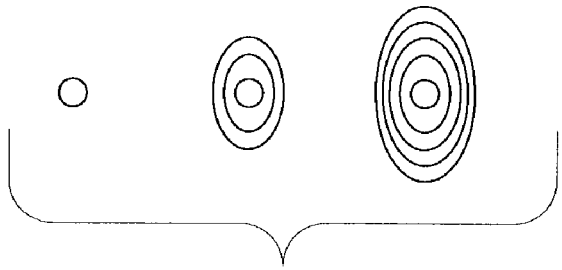
FIGS. 8*a*–8*c* set forth schematic diagrams of non-verbal cue instructions for ultrasonic cleaning devices according to the present invention.
Figure 8B:
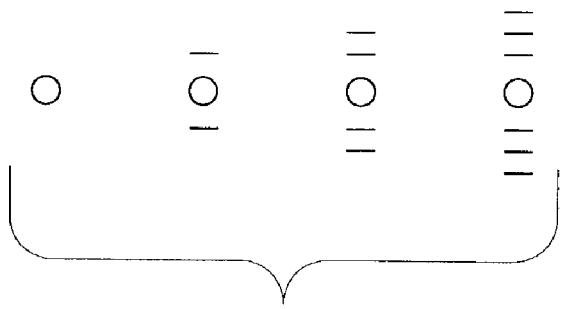
Figure 8C:
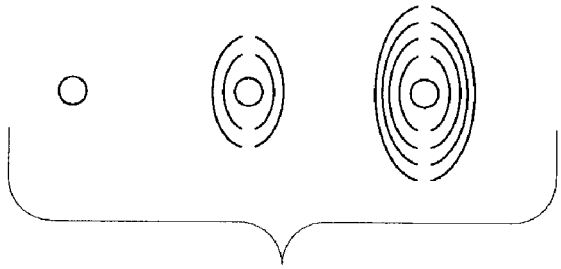

In further embodiments, the ultrasonic cleaning device comprises instructions which facilitate a consumer's use of the ultrasonic cleaning device. For example, such instructions may be adapted to assist an operator in selection of a proper ultrasonic cleaning composition to be dispensed to a surface in need of cleaning, for example depending on the fabric type, i.e., delicate or sturdy, to be cleaned and/or depending on the type of cleaning, i.e., wet versus dry, to be performed. Alternatively, or in addition, such instructions may be adapted to assist an operator in selection of a proper sonotrode tip geometry or size. Similarly, instructions for adjusting the power supply or amplitude at which the sonotrode oscillates relative to a type of fabric surface to be cleaned may be provided. For example, such instructions would recommend lower power or amplitude settings for more delicate fabrics and would recommend higher power or amplitude settings for more sturdy fabric substrates, carpeting, upholstery and the like. Further, instructions for optimal positioning of the sonotrode with respect to a stained surface to optimize a cleaning effect can be provided. As noted previously, in a preferred embodiment, the sonotrode tip is oriented at a substantially perpendicular position with respect to the surface to be cleaned, and instructions for so positioning the sonotrode tip or for holding the shroud to optimize positioning of the tip may be provided. Other instructions for enhancing or optimizing use of the ultrasonic cleaning device can be provided. The instructions included in the ultrasonic cleaning devices according to the invention may comprise verbal instructions and/or non-verbal cues or illustrations. In a preferred embodiment, a combination of verbal instructions and non-verbal cues are provided wherein the non-verbal cues improve user comprehension of verbal instructions and/or improve device performance. FIGS. 8*a*–8*c* set forth exemplary nonverbal cue instructions. In each of FIGS. 8*a*–8*c*, the nonverbal cues represent a lower setting in the left hand portion of the figure, a medium setting in the middle portion of the figure and a higher setting in the right hand portion of the figure. These settings may be directed to sonotrode tip sizes, amplitude settings, power settings, fabric or surface sturdiness, stain type, size or composition, or the like.

The specific illustrations and embodiments described herein are exemplary only in nature and are not intended to be limiting of the invention defined by the claims. Further embodiments and examples will be apparent to one of ordinary skill in the art in view of this specification and are within the scope of the claimed invention.

What is claimed is:

1. An ultrasonic cleaning device comprising a sonotrode adapted to oscillate at an ultrasonic frequency, a tip adapted to contact a soiled surface, a power source adapted to deliver current to the sonotrode, a temperature sensor and a switch which is adapted to interrupt delivery of current from the power supply to the sonotrode if the temperature of a piezoelectric crystal of the sonotrode is sensed as greater than about 70° C., wherein the sonotrode tip has length, width and thickness dimensions, and further wherein the thickness dimension is smaller than the length and width dimensions.

2. An ultrasonic cleaning device comprising a sonotrode adapted to oscillate at an ultrasonic frequency, a tip adapted to contact a soiled surface, a power source adapted to deliver current to the sonotrode, wherein the sonotrode tip has length, width and thickness dimensions, wherein the thickness dimension is smaller than the length and width dimensions and wherein the device further comprises a vacuum source adapted to remove loosened soil particles and residual cleaning composition from a surface being cleaned.

3. An ultrasonic cleaning device comprising a housing, a sonotrode adapted to oscillate at an ultrasonic frequency and adapted to contact a stained surface; a power supply adapted to supply current to the sonotrode; and an indicator light adapted for lighting to indicate a condition of the device to an operator thereof, and a reservoir of ultrasonic cleaning composition wherein the indicator light is adapted for lighting when the content of ultrasonic cleaning composition in the reservoir is low.

4. The ultrasonic cleaning device of claim 3, wherein the indicator light is adjacent a liquid level indicator.

5. The ultrasonic cleaning device of claim 3, further comprising a switch adapted to interrupt the supply of current to the sonotrode if the reservoir is empty.

* * * * *